US008464382B2

(12) United States Patent
Chu

(10) Patent No.: US 8,464,382 B2
(45) Date of Patent: Jun. 18, 2013

(54) MULTI-FUNCTIONAL FOLDING KNIFE

(76) Inventor: Jitung Chu, New Taipei (TW)

( * ) Notice: Subject to any disclaimer, the term of this patent is extended or adjusted under 35 U.S.C. 154(b) by 325 days.

(21) Appl. No.: 13/029,009

(22) Filed: Feb. 16, 2011

(65) Prior Publication Data

US 2012/0204353 A1 Aug. 16, 2012

(51) Int. Cl.
*B26B 11/00* (2006.01)

(52) U.S. Cl.
USPC ..... 7/118; 7/161

(58) Field of Classification Search
USPC ..... 7/118–120, 158, 161
See application file for complete search history.

(56) References Cited

U.S. PATENT DOCUMENTS 1,204,676 A * 11/1916 Machuga ..... 7/118
D154,482 S * 7/1949 Hill ..... 7/161
2007/0245497 A1* 10/2007 Tsuda et al. ..... 7/118

* cited by examiner

*Primary Examiner* — Hadi Shakeri
(74) *Attorney, Agent, or Firm* — patenttm.us

(57) ABSTRACT

A multi-functional folding knife has a handle and a blade. The blade is rotatably connected to the handle and has a cutting segment, a screwdriver head, a rope recess, a peak segment and an engaging mouth. The cutting segment is formed on a bottom of the blade and has a straight edge and a saw-tooth edge. The screwdriver head is formed on and protrudes from a top of the blade and is slotted and flat in shape. The rope recess is obliquely formed in the top of the blade adjacent to the screwdriver head and has a severing edge. The peak segment is formed on and protrudes from the top of the blade near the middle and adjacent to the rope recess. The engaging mouth is formed downwardly in the top of the blade between the peak segment and a rear end of the blade and has an engaging hook.

2 Claims, 5 Drawing Sheets

MULTI-FUNCTIONAL FOLDING KNIFE

BACKGROUND OF THE INVENTION

1. Field of the Invention

The present invention relates to a folding knife, and more particularly to a folding knife that has multi-functions in use.

2. Description of Related Art

A conventional folding knife such as a Swiss Army Knife or a pocketknife usually has a handle and multiple types of blades. The blades are pivotally connected to the handle to provide different usages such as a can piercer or a screwdriver and can be folded into the handle of the Swiss Army Knife or the pocketknife for transport and carry. However, the blades that are connected to the body of the Swiss Army Knife or the pocket knife will increase the weight and volume of the Swiss Army Knife or the pocket knife and this is inconvenient for carriage. In addition, each blade of the conventional folding knife only has one single shape or one single function in use and this will limit the practicability of each blade. Furthermore, the distance between the handle and a top end of a flat screwdriver blade of the Swiss Army Knife or the pocketknife is short and cannot provide larger moment of force to rotate a screw bolt and this is laborious in use.

To overcome the shortcomings, the present invention provides a multi-functional folding knife to mitigate or obviate the aforementioned problems.

SUMMARY OF THE INVENTION

The main objective of the present invention is to provide a multi-functional folding knife that has multi-functions in use.

The multi-functional folding knife in accordance with the present invention has a handle and a blade. The blade is rotatably connected to the handle, can be folded into the handle and has a rear end, a middle, a front end, a top, a bottom, a cutting segment, a screwdriver head, a rope recess, a peak segment and an engaging mouth. The cutting segment is formed on the bottom of the blade between the ends of the blade and has a straight edge and a saw-tooth edge. The screwdriver head is formed on and protrudes from the top of the blade at the front end and is slotted and flat in shape. The rope recess is obliquely formed in the top of the blade adjacent to the screwdriver head and has a severing edge 231. The peak segment is formed on and protrudes from the top of the blade near the middle and adjacent to the rope recess. The engaging mouth is formed downwardly in the top of the blade between the peak segment and the rear end of the blade and has an engaging hook.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
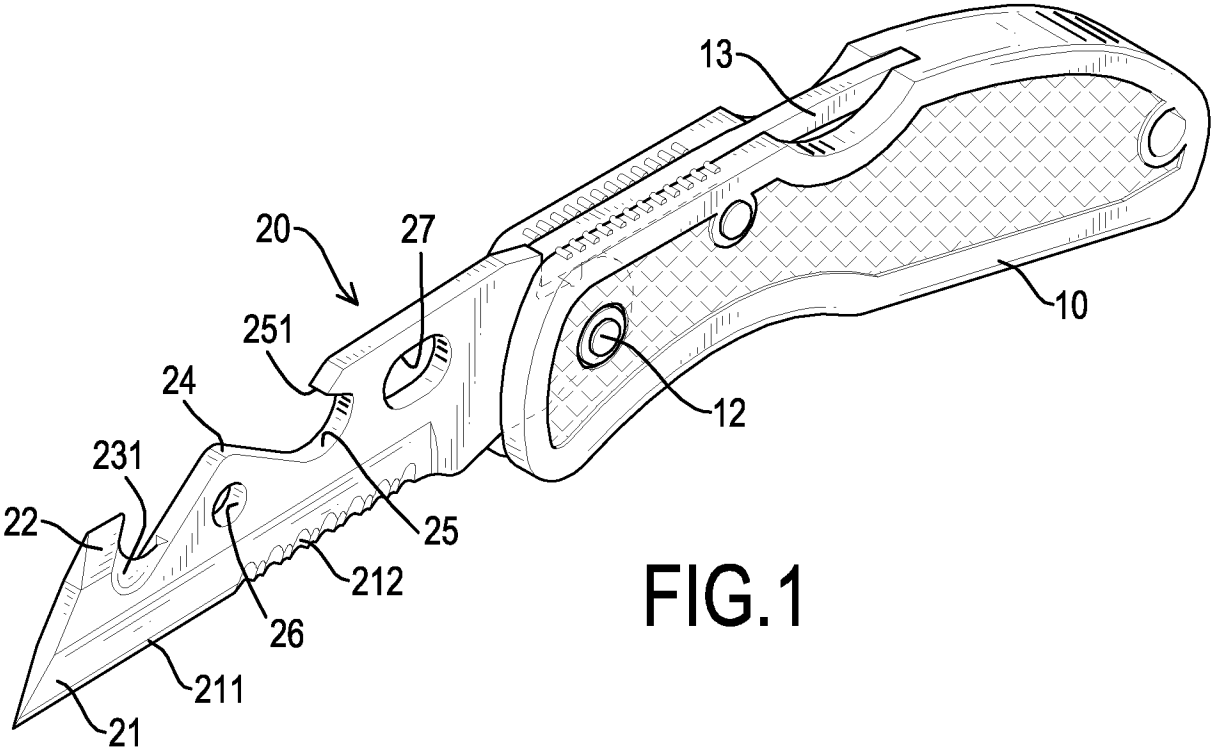
FIG. 1 is a perspective view of a multi-functional folding knife in accordance with the present invention.
Figure 3:
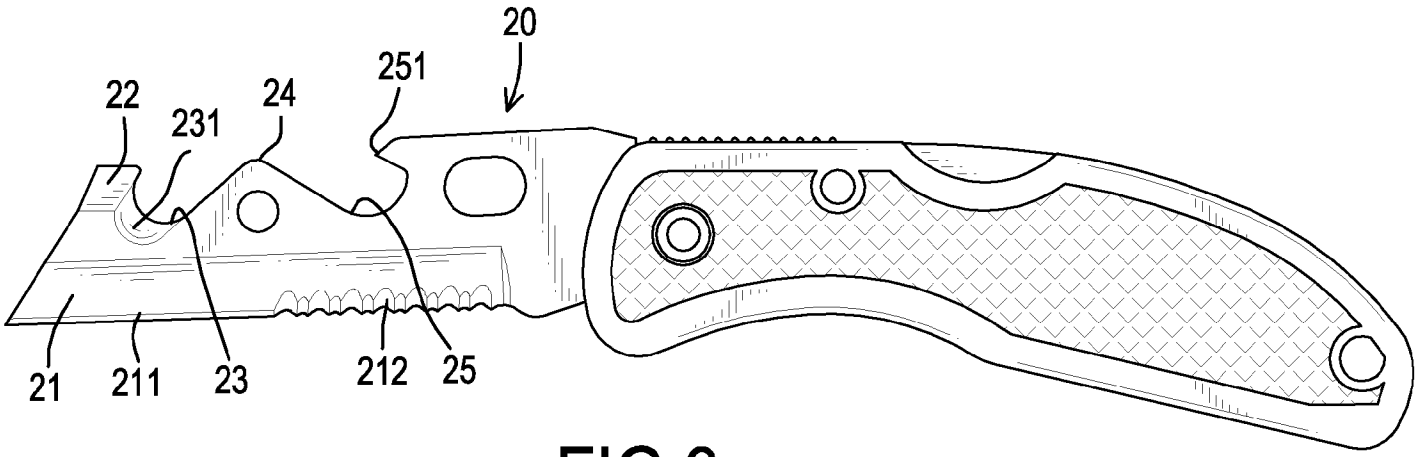
FIG. 3 is a side view of the multi-functional folding knife in FIG. 1.
Figure 2:
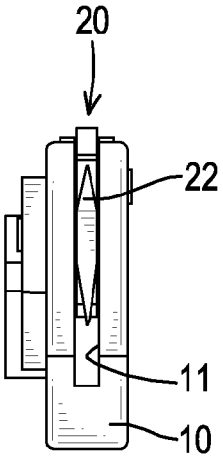
FIG. 2 is a front view of the multi-functional folding knife in FIG. 1.

With reference to FIGS. 1 to 3, a multi-functional folding knife in accordance with the present invention has a handle 10 and a blade 20.

The handle 10 has a front end, a rear end, a bottom, a top, two sidewalls, a chamber 11, a pintle 12 and a positioning board 13. The chamber 11 is formed in the handle 10 between the sidewalls and is formed through the front end and the bottom of the handle 10. The pintle 12 is transversally connected to the sidewalls of the handle 10 near the front end of the handle 10. The positioning board 13 is pivotally connected to the sidewalls of the handle 10 at the top of the handle 10 and has a rear end and a positioning front end extending to the front end of the handle 10.

The blade 20 is rotatably connected to the handle 10, can be folded into the chamber 11 of the handle 10 and has a rear end, a middle, a front end, a top, a bottom, a cutting segment 21, a screwdriver head 22, a rope recess 23, a peak segment 24, an engaging mouth 25, a first holding hole 26 and a second holding hole 27.

The blade 20 is connected to the pintle 12 of the handle 10 near the rear end of the blade 20. The rear end of the blade 20 selectively engages with the positioning front end of the positioning board 13. When a user presses the positioning board 13 near the rear end of the positioning board 13, the positioning front end of the positioning board 13 will move upwardly to separate from the rear end of the blade 20. Then, the blade 20 can be rotated downwardly and folded in the chamber 11 of the handle 10.

The cutting segment 21 is formed on the bottom of the blade 20 between the ends of the blade and has a straight edge 211 and a saw-tooth edge 212. The straight edge 211 is formed on the bottom of the blade 20 between the front end and the middle of the blade 20. The saw-tooth edge 212 is formed on the bottom of the blade 20 between the middle and the rear end of the blade 20 and is connected with the straight edge 211.

The screwdriver head 22 is formed on and protrudes from the top of the blade 20 at the front end of the blade 20 and is slotted and flat in shape. The rope recess 23 is obliquely formed in the top of the blade 20 adjacent to the screwdriver head 22 and has a bottom and a severing edge 231. The severing edge 231 is formed on the bottom of the rope recess 23.

The peak segment 24 may be curved and is formed on and protrudes from the top of the blade 20 near the middle of the blade 20 and adjacent to the rope recess 23 and has a top end. The engaging mouth 25 is formed downwardly in the top of the blade 20 between the peak segment 24 and the rear end of the blade 20 and has a front end and an engaging hook 251. The engaging hook 251 is formed on and protrudes forwardly from the front end of the engaging mouth 25 and faces the top end of the peak segment 24.

The first holding hole 26 may be circular and is formed through the blade 20 between the peak segment 24 and the cutting segment 22 and is at a position outside the handle 10 when the blade 20 is folded into the chamber 11. The second holding hole 27 may be elongated and is formed through the blade 20 between the engaging mouth 25 and the rear end of the blade 20 and is at a position outside of the handle 10 when the blade 20 is folded into the chamber 11.

With reference to FIGS. 1 to 3, when the multi-functional folding knife needs to be folded for transport and carry, the user can press the positioning board 13 near the rear end of the positioning board 13 to enable the rear end of the blade 20 to disengage from the positioning front end of the positioning board 13. Then, the blade 20 can be rotated downwardly and folded into the chamber 11 of the handle 10 to reduce the volume of the multi-functional folding knife. In addition, the multi-functional folding knife in the present invention only has one single blade 20 and this can decrease the weight and the volume of the multi-functional folding knife.

When the user needs to use the multi-functional folding knife in accordance with the present invention, one hand of the user holds the handle 10 and the other hand holds the first holding hole 26 or the second holding hole 27 of the blade 20 to enable the blade 20 to rotate upwardly out of the chamber 11 of the handle 10 and to enable the rear end of the blade 20 to engage with the positioning front end of the positioning board 13 as shown in FIGS. 1 and 2. Then, the blade 20 can be held securely on the handle 10. The straight edge 211 and the saw-tooth edge 212 of the cutting segment 21 that are formed on the bottom of the blade 20 can be used to cut or to saw an object.

Figure 4:
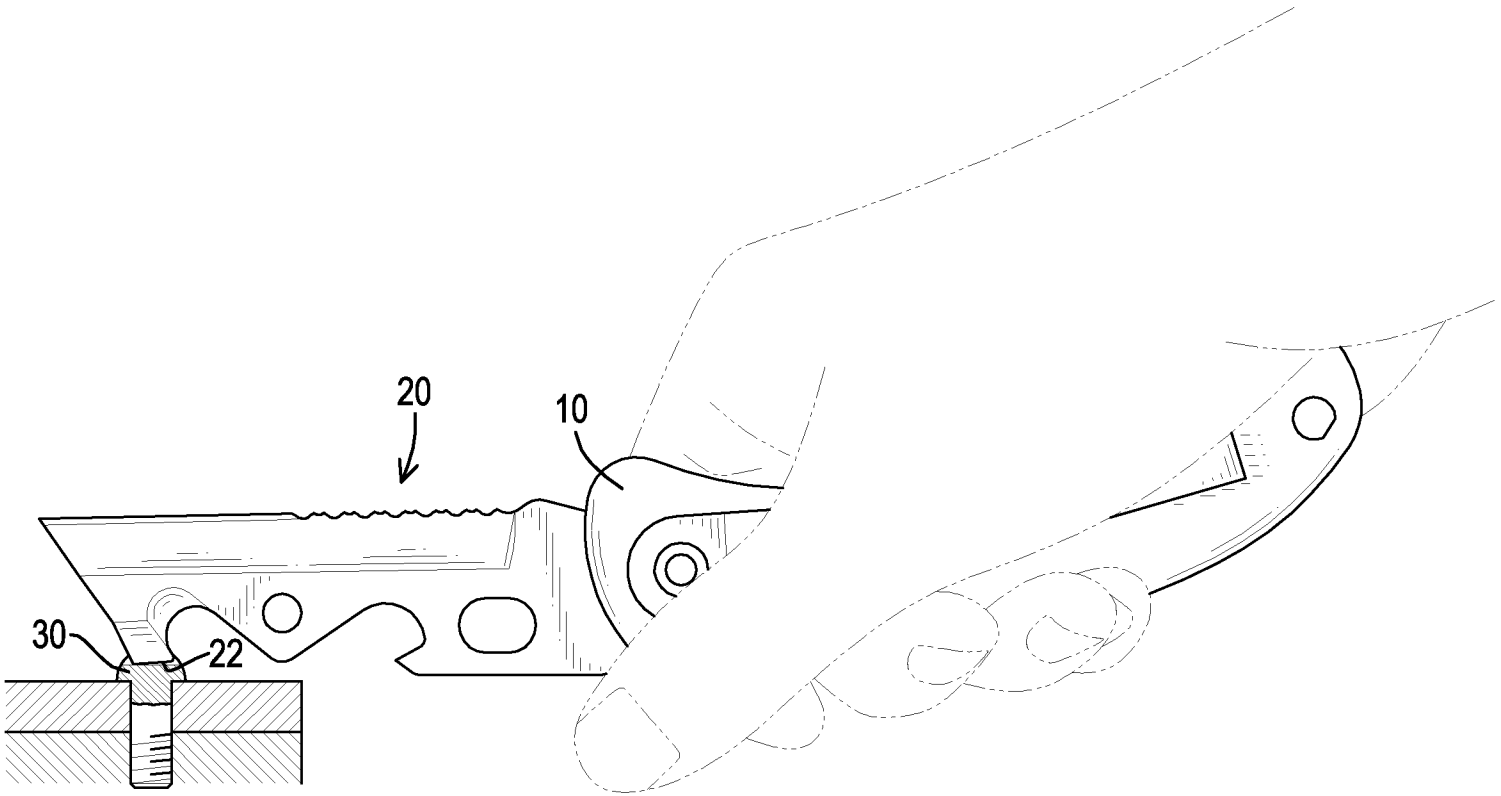
FIG. 4 is an operational side view in partial section of the multi-functional folding knife in FIG. 1.

With reference to FIG. 4, when the user turns and places the top of the blade 20 upside down, the screwdriver head 22 of the blade 20 can be used to fasten or loosen a screw bolt 30. In operation, the screwdriver head 22 is formed on the front end of the blade 20 and this can provide larger moment of force to rotate the screw bolt 30 when the user holds the handle 10 and this is labor-saving in use.

Figure 5:
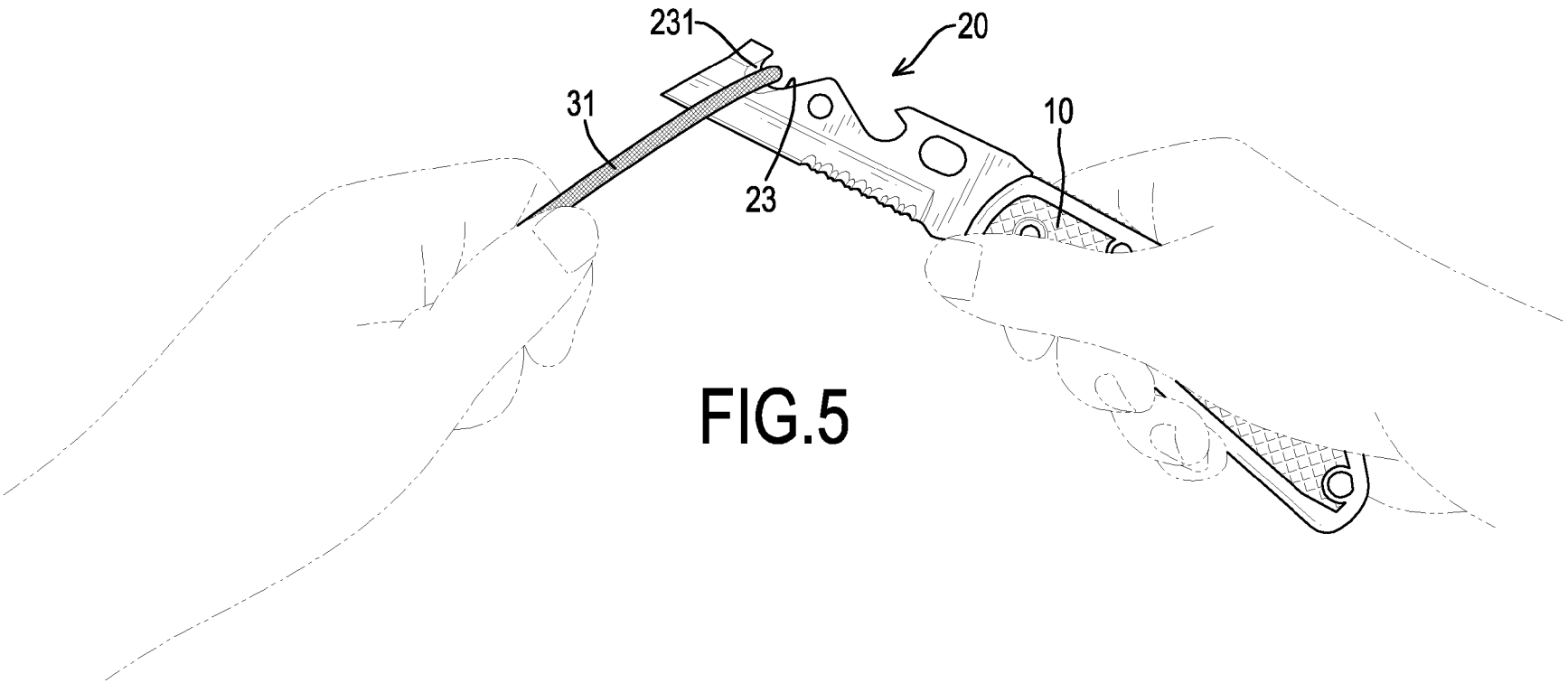
FIG. 5 is another operational side view of the multi-functional folding knife in FIG. 1.
Figure 6:
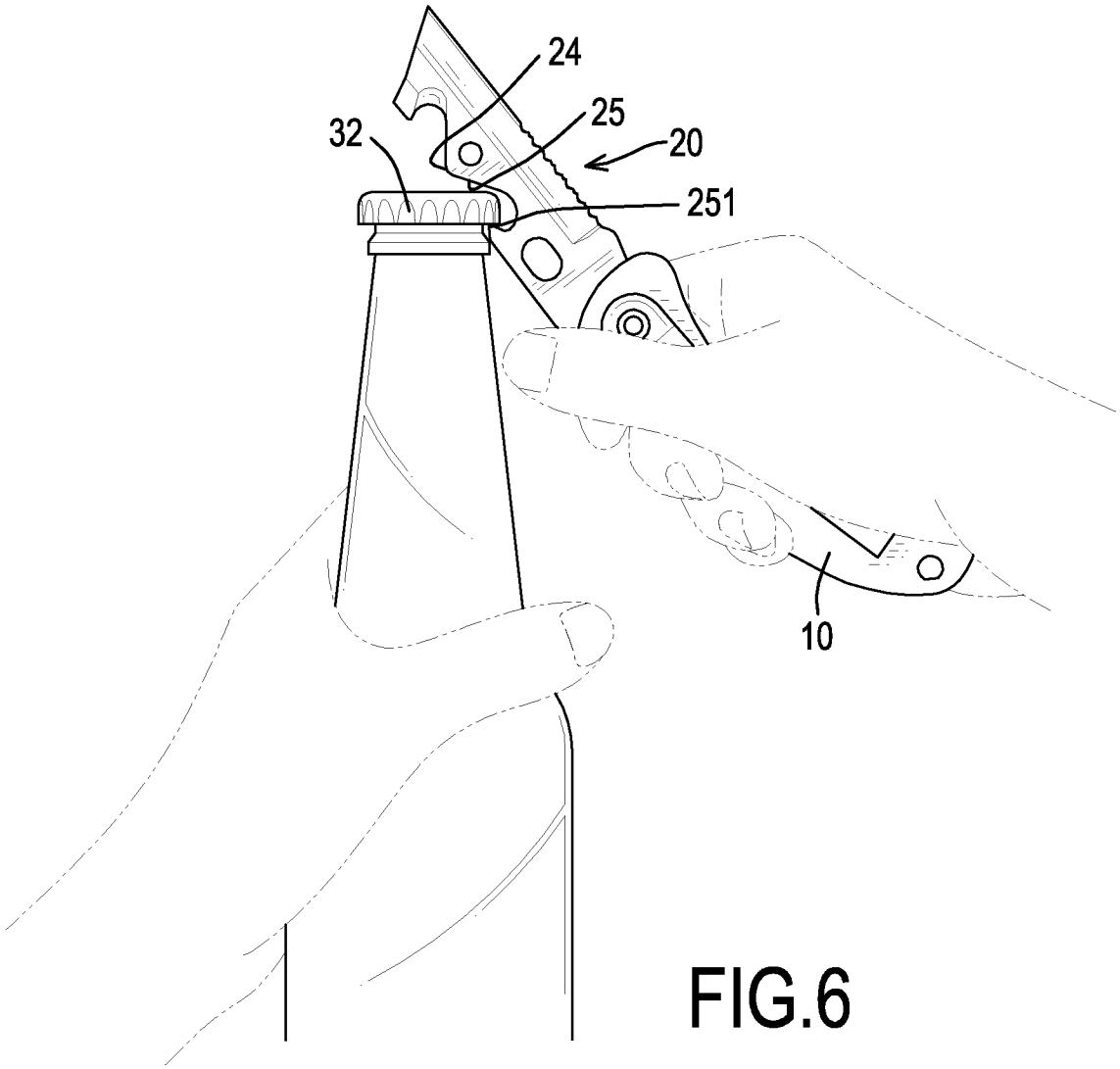
FIG. 6 is a further operational side view of the multi-functional folding knife in FIG. 1.

With reference to FIG. 5, when using the multi-functional knife in accordance with the present invention to sever a rope 31, the user can put the rope 31 in the rope recess 23 and pull the handle 10 and the rope 31 at the same time in the opposite directions continually. Then, the rope 31 can be severed into two pieces by the severing edge 231 of the rope recess 23. Furthermore, with reference to FIG. 6, the user can position the peak segment 24 of the blade 20 to abut a top of a bottle cap 32 and put the engaging hook 251 of the engaging mouth 25 in a bottom of the bottle cap 32. Then, the user can use the peak segment 24 of the blade 20 as a pivot and rotates the handle 10 upwardly to open the bottle cap 32 from a corresponding bottle by the engaging hook 251 of the engaging mouth 25.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-functional folding knife having a handle and a blade pivotally connected to the handle and characterized in that the blade of the multi-functional folding knife comprises:

a rear end;

a middle;

a front end;

a top;

a bottom;

a cutting segment formed on the bottom of the blade between the ends of the blade and having a straight edge formed on the bottom of the blade between the front end and the middle of the blade; and a saw-tooth edge formed on the bottom of the blade between the middle and the rear end of the blade and connected with the straight edge;

a screwdriver head formed on and protruding from the top of the blade at the front end of the blade and being slotted and flat in shape;

a rope recess obliquely formed in the top of the blade adjacent to the screwdriver head and having a bottom; and a severing edge formed on the bottom of the rope recess;

a peak segment formed on and protruding from the top of the blade near the middle of the blade and adjacent to the rope recess; and an engaging mouth formed downwardly in the top of the blade between the peak segment and the rear end of the blade and having a front end; and an engaging hook formed on and protruding forwardly from the front end of the engaging mouth.

2. The multi-functional folding knife as claimed in claim 1, wherein the blade further has a first holding hole formed through the blade between the peak segment and the cutting segment; and a second holding hole formed through the blade between the engaging mouth and the rear end of the blade.

* * * * *